US011090549B2

(12) United States Patent
Lee

(10) Patent No.: US 11,090,549 B2
(45) Date of Patent: Aug. 17, 2021

(54) SNOWBOARD BINDING

(71) Applicant: Ni-Shin Lee, Hsinchu County (TW)

(72) Inventor: Ni-Shin Lee, Hsinchu County (TW)

( * ) Notice: Subject to any disclaimer, the term of this patent is extended or adjusted under 35 U.S.C. 154(b) by 0 days.

(21) Appl. No.: 16/850,709

(22) Filed: Apr. 16, 2020

(65) Prior Publication Data

US 2021/0146229 A1 May 20, 2021

(30) Foreign Application Priority Data

Nov. 19, 2019 (TW) ..... 108141967

(51) Int. Cl.

| | |
|---|---|
| ***A63C 10/28*** | (2012.01) |
| ***A63C 10/16*** | (2012.01) |
| ***A63C 10/08*** | (2012.01) |
| ***A63C 10/06*** | (2012.01) |

(52) U.S. Cl.

CPC ..... *A63C 10/16* (2013.01); *A63C 10/06* (2013.01); *A63C 10/08* (2013.01); *A63C 10/28* (2013.01)

(58) Field of Classification Search

CPC ..... A63C 5/031; A63C 7/005

See application file for complete search history.

(56) References Cited

U.S. PATENT DOCUMENTS 4,066,276 A * 1/1978 Salomon ..... A63C 7/106 280/605
5,356,168 A * 10/1994 Ozburn ..... A63C 5/061 280/14.21
6,007,101 A * 12/1999 Pritchard ..... A63C 5/03 280/14.22
6,279,924 B1 * 8/2001 Murphy ..... A63C 10/12 280/14.23
8,083,251 B2 * 12/2011 Wasserman ..... A63C 7/1066 280/604
8,157,285 B2 * 4/2012 Wasserman ..... A63C 5/03 280/604
8,286,989 B2 * 10/2012 Wasserman ..... A63C 7/1066 280/604
8,646,800 B2 * 2/2014 Bertagnolio ..... A63C 10/04 280/605
9,895,597 B2 * 2/2018 Suda ..... A63C 10/28
2004/0041366 A1 * 3/2004 Dandurand ..... A63C 7/1053 280/631
2007/0075524 A1 * 4/2007 Kelly ..... A63C 7/106 280/605

* cited by examiner

*Primary Examiner* — Jeffrey J Restifo

(74) *Attorney, Agent, or Firm* — Muncy, Geissler, Olds & Lowe, P.C.

(57) ABSTRACT

A snowboard binding using for a snowboard is provided. The snowboard binding includes a baseplate, a boot supporter surrounding the baseplate, an interlocking assembly, and a stopper disposed on the interlocking assembly. The boot supporter includes a first side, a second side, and a rear side. The interlocking assembly is disposed at the first side of the boot supporter. A mutual positional relationship between the interlocking assembly and the snowboard presents an initial state. As snowboard boot touches the interlocking assembly to change the initial state while the snowboard boot is put in and fixed to the snowboard binding. Concurrently the interlocking assembly drives the stopper to rotate so that the stopper leaves or inserts into snowfield.

9 Claims, 6 Drawing Sheets

SNOWBOARD BINDING

CROSS-REFERENCE TO RELATED APPLICATIONS

This application claims the benefit of TW108141967, filed on Nov. 19, 2019, the content of which are hereby incorporated by reference in their entirety

FIELD OF THE INVENTION

The present invention relates to a snowboard binding, particularly relates to a snowboard binding with anti-sliding function.

BACKGROUND OF THE INVENTION

The anti-sliding means of ski equipment, such as a break, is usually set on the snowboard, so players can stop freely in movement. There is almost no snowboard binding with anti-sliding design on the market. When the snowboard is accidentally upside lay down in snowfield, someone may step on it and lose his/her balance to fall down; or when the snowboard is arbitrarily placed on the slope, it causes the snowboard binding slide away following the snowboard, and a danger is arisen to other players during skiing.

SUMMARY OF THE INVENTION

According to above mentioned problems and deficiencies, an object of the present invention is to provide a snowboard binding which can keep the snowboard equipped with the snowboard binding fixed on snowfield without sliding away.

According to the mentioned object, the snowboard binding is provided, comprising a baseplate, a boot supporter having a first side, a second side and a heel cup, wherein the boot supporter surrounds the baseplate to form an accommodation boot space for placing a snowboard boot of different sizes; an interlocking assembly disposed at the first side of the boot supporter, wherein a mutual positional relationship between the interlocking assembly and the snowboard represents an initial state; and a stopper fixed to the interlocking assembly, and the length of the stopper is provided for inserting into a snowfield. While the snowboard boot is placed in the accommodation boot space and fixed to the snowboard binding, the interlocking assembly is triggered and then changes the initial state, and simultaneously drives the stopper to rotate, so that the stopper leaves or inserts into the snowfield.

When a user is snowboarding, the stopper set on the snowboard binding is parallel to the snowfield to avoid touching and scrubbing the snowfield. Only when the user opens the ankle strap and step in/out the snowboard binding, the stopper is perpendicular to the snowfield and inserted into snowfield, so that the snowboard equipped with the snowboard binding is fixed on the snowfield and does not slide away. The stopper carries out anti-sliding function.

DETAILED DESCRIPTION OF THE PREFERRED EMBODIMENT

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Figure 1:
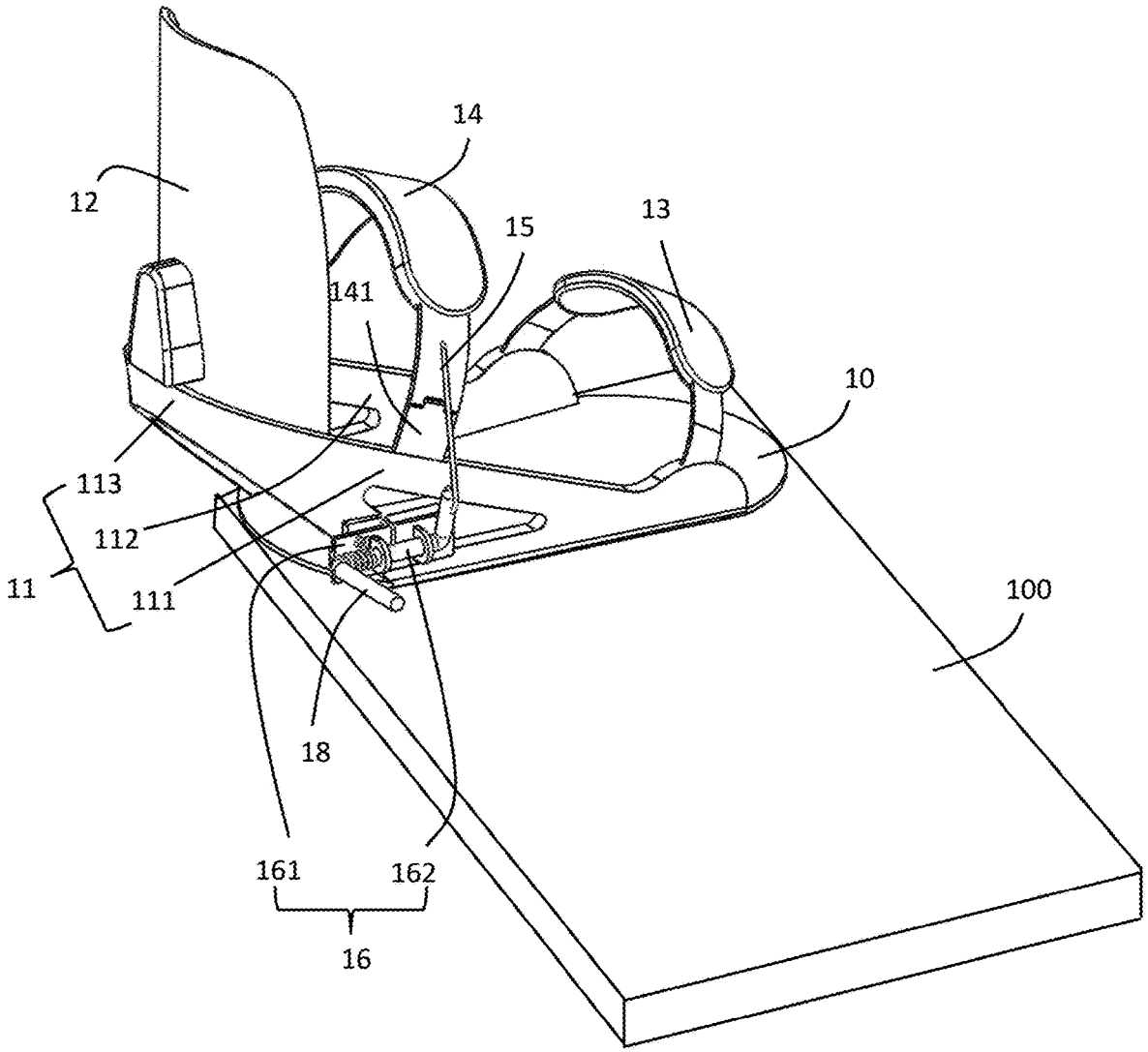
FIG. 1 is a perspective view showing an ankle strap of a snowboard binding is disposed at a locked position according to the present invention.

First, please refer to FIG. 1 showing an ankle strap of a snowboard binding is disposed at a locked position according to the present invention. As shown in FIG. 1, the snowboard binding is mounted on a snowboard 100, and provided to play snowboarding after a user places a snowboard boot into the snowboard binding. The snowboard binding includes a baseplate 10, a boot supporter 11, a highback 12, a toe strap 13, an ankle strap 14, an interlocking assembly 16, and a stopper 18 set on the interlocking assembly 16.

The boot supporter 11 surrounds the baseplate 10 to form an accommodation boot space for placing the snowboard boot of different sizes. The boot supporter 11 includes a first side 111, a second side 112, and a heel cup 113. The first side 111 and the second side 112 of the boot supporter 11 are connected by the heel cup 113 and unified into one-piece. An opening is formed between the first side 111 and the second side 112 on the front part of the baseplate 10. This opening allows a toe cap of the snowboard boot disposed in the accommodation boot space to protrude outwards.

A highback 12 is lean on the heel cup 113 of the boot supporter 11 and extends upward along the heel cup of a snowboard boot for providing the snowboard boot with aft support.

The toe strap 13 is disposed on the front part of the snowboard binding opposite to the heel cup 113 of the boot supporter 11. That is, the toe strap 13 is near opening at the front part of the baseplate 10, and extends from the first side 111 to the second side 112 of the boot supporter 11. The toe strap 13 is disposed correspondingly at the position of the toe cap of the snowboard boot at the accommodation boot space and used to fasten the toe cap of the snowboard boot which the user wears.

The ankle strap 14 is set on the snowboard binding near the highback 12 and disposed between the toe strap 13 and the highback 12, and extends from the first side 111 to the second side 112 of the boot supporter 11. The ankle strap 14 is disposed correspondingly at the position of an ankle of the snowboard boot at the accommodation shoe space and used to fasten the ankle of the snowboard boot which the user wears. The ankle strap 14 has two ends respectively connected to an ankle ladder 141 and a ratchet (not shown in figures). The ankle ladder 141 is disposed at the first side 111 of boot supporter 11 and keeps attached to the ankle strap 14, that is the ankle strap 14 disposed at a locked position. A ratchet (not shown in figures) is disposed at the second side 112 of the boot supporter 11, and includes such a push button (not shown in figures). The ankle strap 14 is detached from the ratchet is conducted by pressing the push button, and the ankle strap 14 is open, that is the ankle strap 14 disposed at a unlocked position. As a result, the snowboard boot can be placed into the accommodation boot space.

In this embodiment, the snowboard binding further comprises a connective rope 15 which is disposed at the ankle strap 14 near the ankle ladder 141. Two ends of connective rope 15 respectively connect to the ankle strap 14 and the interlocking assembly 16. The interlocking assembly 16 is disposed at the first side 111 of the boot supporter 11 and locates below the ankle ladder 141.

Figure 2:
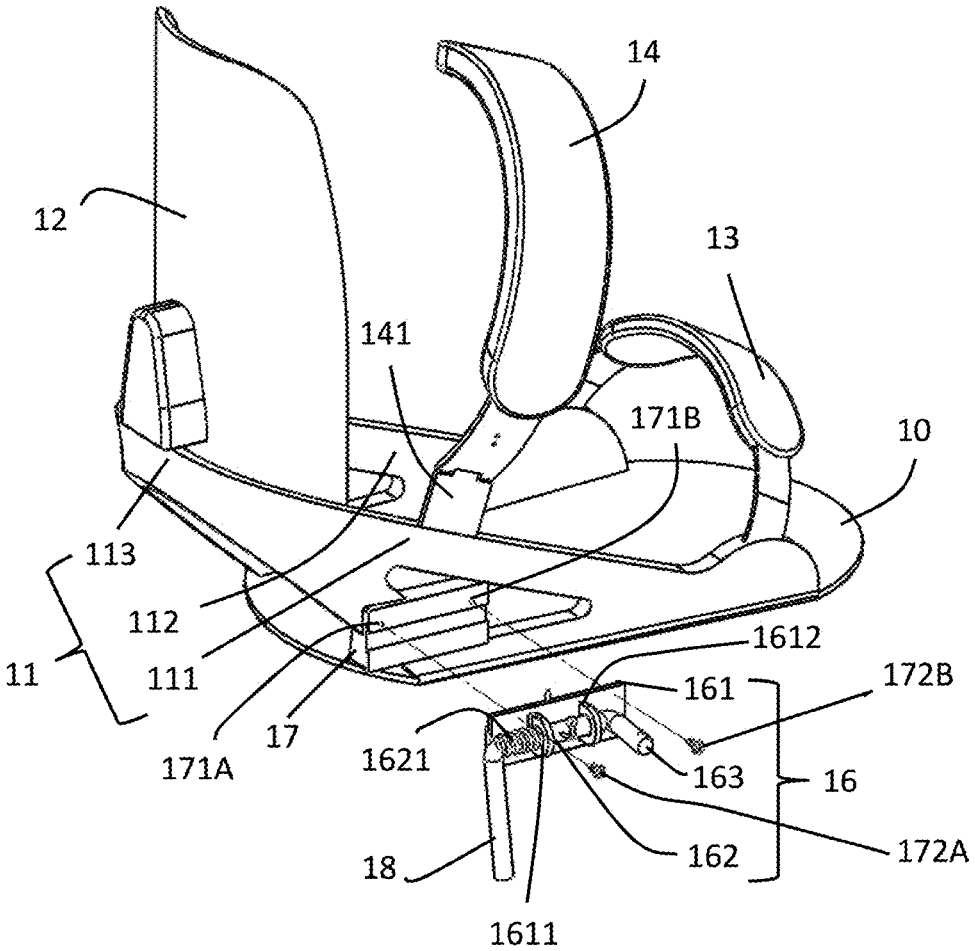
FIG. 2 is an explosive perspective view showing the snowboard binding and the interlocking assembly according to the present invention.

Next, please refer to FIG. 2 showing explosive perspective view of the snowboard binding and the interlocking assembly. As shown in FIG. 2, an auxiliary 17 is disposed below the ankle ladder 141 of the boot supporter 11. The interlocking assembly 16 includes a base 161 and a main rod 162, and the base 161 is fixed on the auxiliary 17. The interlocking assembly 16 is provided with a first screw hole 161A and a second screw hole 161B perforating the base 161 (referred to FIG. 3). The first screw hole 161A and the second screw hole 161B are aligned with a first pivot hole 171A and a second pivot hole 171B on the auxiliary 17. The base 161 is affixed to the auxiliary 17 by connecting to a first pivot hole 171A of the auxiliary 17 after a first screw 172A perforating through the first screw hole 161A of the base 16, and by connecting to a second pivot hole 171B of the auxiliary 17 after a second screw 172B perforating through the second screw hole 161B of the base 16. Therefore, the interlocking assembly 16 is provided for connecting to the first side 111 of boot supporter 11 and close to the lower of the ankle ladder 141. FIG. 2 is only one embodiment of the present invention, the detail conformation of the interlocking assembly 16 is not limited as described in FIG. 2, further other components may be derived.

Figure 3:
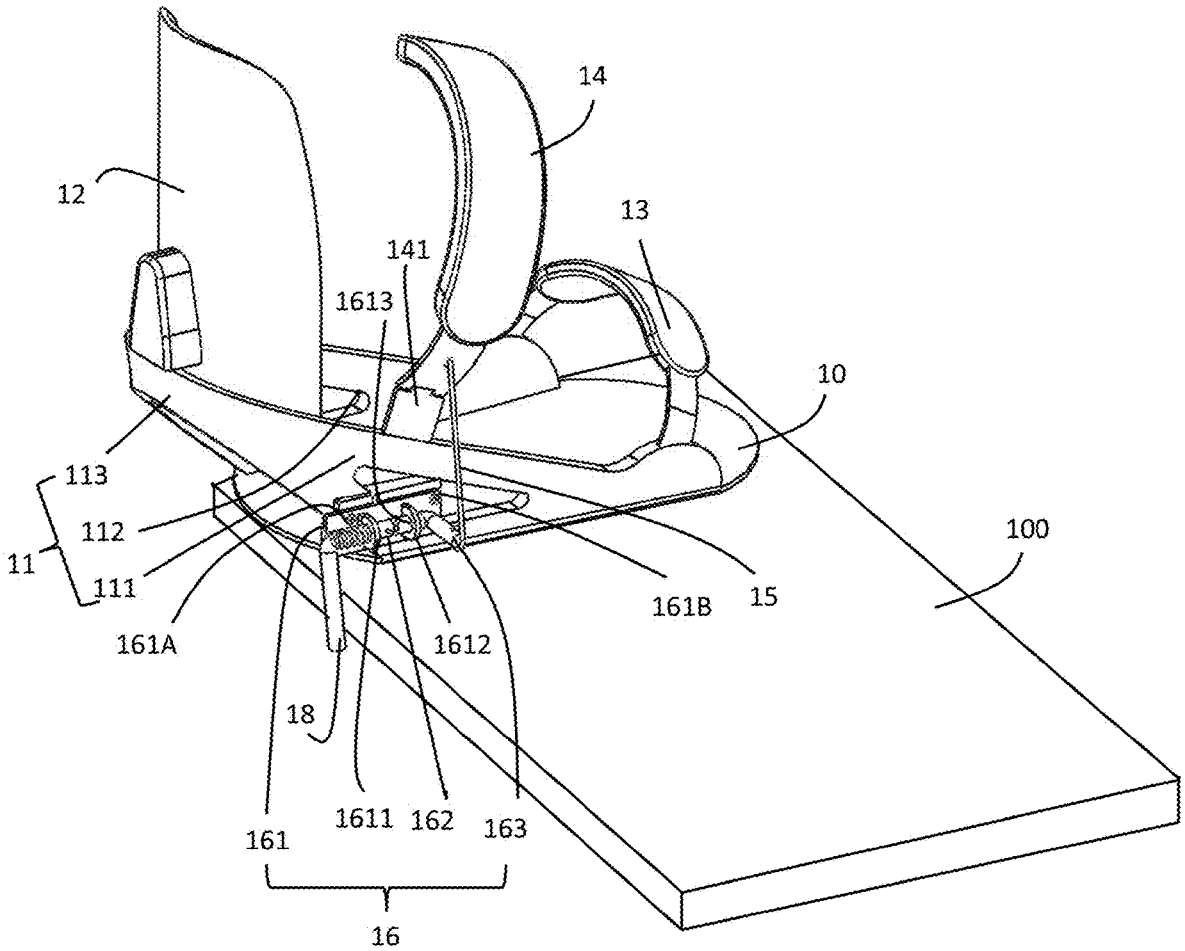
FIG. 3 is a perspective view showing the ankle strap of the snowboard binding is disposed at an unlocked position according to the present invention.

Next, please refer to FIG. 3 showing the ankle strap of the snowboard binding. In FIG. 3, a first block ring 1611 and a second block ring 1612 are set between the first screw hole 161A and the second screw hole 161B of the base 161. The first block ring 1611 and the second block ring 1612 are circular with a shaft hole 1613 in the center. The main rod 162 which passes through the shaft holes 163 of the first block ring 1611 and the second block ring 1612 is blocked from the first block ring 1611 by sticking a spring 1621 near the first block ring 1611, so that the main rod 162 is latched to the base 161. A linkage 163 and a stopper 18 are respectively set at two ends of the main rod 162. The stopper 18 is disposed at one end near the spring 1621, and the linkage 163 at the other end connects to the connective rope 15 on the ankle strap 14. With reference to FIG. 1, when the ankle strap 14 is disposed at the locked position where the ankle strap 14 connects to the ratchet, the mutual positional relationship between the interlocking assembly 16 and the snowboard 100 represents the initial state which means that the linkage 163 and the snowboard 100 are perpendicular to each other, and the stopper 18 extends outward the baseplate 10 from the base 161 and parallels the baseplate 10, that is the stopper 18 extends and parallels the snowfield.

As shown in FIG. 3, when the user wants to place the snowboard boot into the accommodation boot space of the snowboard binding, the ankle strap 14 is detached from the ratchet by pressing the push button to detach the ankle strap 14. The ankle strap 14 moves form the locked position to an unlocked position. Wherein the unlocked position means that the ankle strap 14 separates from the ratchet with an angle ranging from 90° to 180°. And an angle between the ankle strap 14 and the ankle ladder 141 ranges from 90° to 180°, so that the snowboard boot is easy to be placed in the accommodation boot space. In this embodiment, when the ankle strap 14 is disposed at the unlocked position, the mutual positional relationship between the interlocking assembly 16 and the snowboard 100 represents the initial state which means that the linkage 163 parallels the snowboard 100 each other, and the stopper 18 extends toward the baseplate 10 from the base 161 and inserts into the snowfield. The length of the stopper 18 is enough to insert into the snowfield, so that the snowboard 100 where the snowboard binding is mounted is fixed on the snowfield and free from sliding away.

When the ankle strap 14 moves from the locked position to the unlocked position, the connective rope 15 is driven to move forward to the snowfield, simultaneously the linkage 163 changes the initial state to rotate toward the snowboard 100, and then triggers the rotation of the stopper 18 in the direction from parallel to perpendicular to the baseplate 10, and the stopper 18 is perpendicular to the snowfield and inserted into the snowfield; when the ankle strap 14 moves from the unlocked position to the locked position, the connective rope 15 is driven to leave the snowfield, simultaneously the linkage 163 changes the initial state to rotate away from the snowboard 100, and then triggers the rotation of the stopper 18 in the direction from perpendicular to parallel to the baseplate 10, and the stopper 18 leaves the snowfield. In other words, the stopper 18 is perpendicular to the snowfield when the ankle strap 14 is disposed at the unlocked position, and the stopper 18 is parallel to the snowfield when the ankle strap 14 is disposed at the locked position. Therefore, once the user presses the push button of the ratchet (not shown in figures) to detach the ankle strap 14 and put the snowboard boot in/out the snowboard binding, the stopper 18 is driven to rotate perpendicularly to the snowfield and inserted into the snowfield, so that the snowboard 100 where the snowboard binding is mounted is fixed on the snowfield and free from sliding away.

Figure 4:
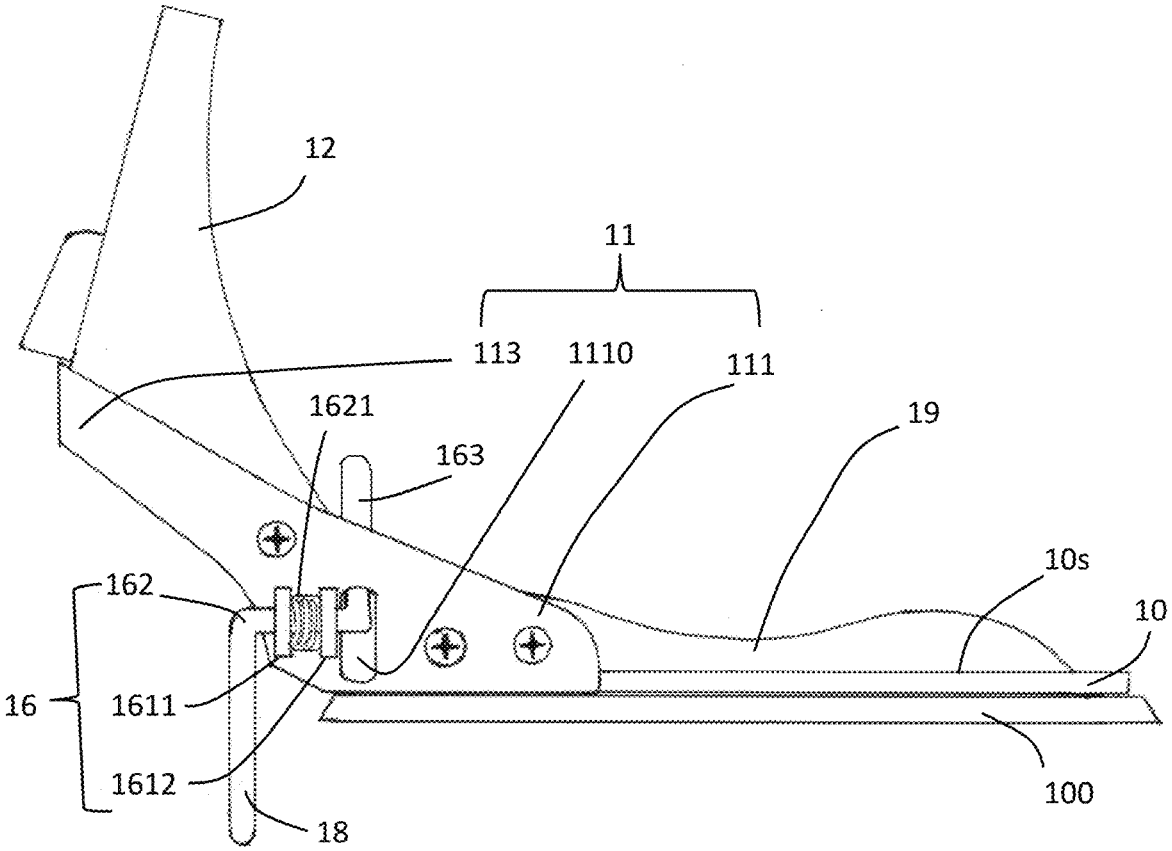
FIG. 4 is a partial side view showing another snowboard binding according to another embodiment of the present invention.

Another embodiment of the preset invention is referred to FIG. 4 showing a partial side view of another snowboard binding. As shown in FIG. 4, the snowboard comprises a baseplate 10 mounted on the snowboard 100, a boot supporter 11, a highback 12, a toe strap 13, an ankle strap 14, an interlocking assembly 16, and a stopper 18 set on the interlocking assembly 16. Although the toe strap 13 and ankle strap 14 are not illustrated in FIG. 4, the boot supporter 11, highback 12, the toe strap 13, and the ankle strap 14 are specifically illustrated in FIG. 1-FIG. 3, so there is no more explanation about them repeatedly.

The interlocking assembly 16 comprises a base 161 and a main rod 162, and the base 161 is screwed at a first side 111 of the boot supporter 11. A first block ring 1611 and a second block ring 1612 are set on the base 161 and circular shape with a shaft hole 163 in the center. The main rod 162, passing through the shaft holes 1613 of the first block ring 1611 and the second block ring 1612, is latched on the base 161 by sticking a spring 1621 between the first block ring 1611 and the second block ring 1612. A linkage 163 and a stopper 18 are respectively set at two ends of the main rod 162. The stopper 18 is set at one end near the first block ring 1611, and the linkage 163 is at the other end opposite to the one end where the stopper 18 locates.

In this embodiment, the first side 111 has a hollow part 1110 for the linkage 163 passing through. The size of the hollow part 1110 is not limited as long as the linkage 163 can pass through.

Figure 5A:
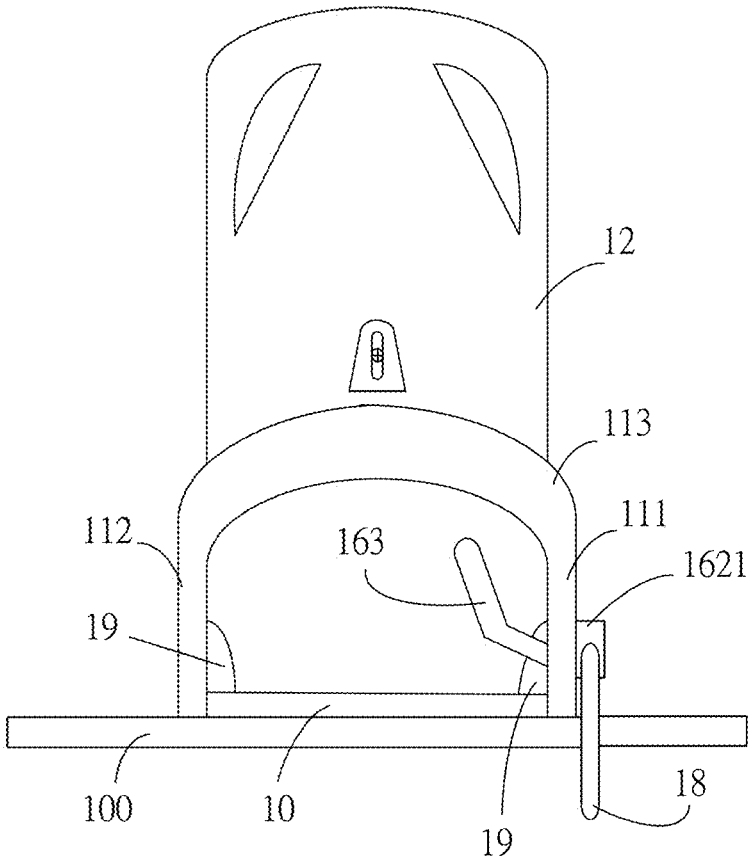
FIG. 5A is a schematic rear view illustrating state that there is no snowboard boot placed in the snowboard binding according to another embodiment of the present invention.

Next, please refer to FIG. 5A illustrating state that the snowboard boot is not placed in the snowboard binding. As shown in FIG. 5A, two side walls 19, disposed on the edge 10*s* of the baseplate 10, are respectively screwed to a first side 111 and a second side 112. A hollow part is formed between the two side walls 19 at front end of the baseplate 10. The hollow part is provided for a toe cap of a snowboard boot in an accommodation shoe place to protrude outward. Before the snowboard boot is not placed into the snowboard binding, an initial state of a linkage 163 is kept upward due to the elastic force of a spring 1621, and a state of a stopper 18 is inserted into the snowfield to keep the snowboard 100 equipped with the said snowboard binding in fixed on the snowfield.

Figure 5B:
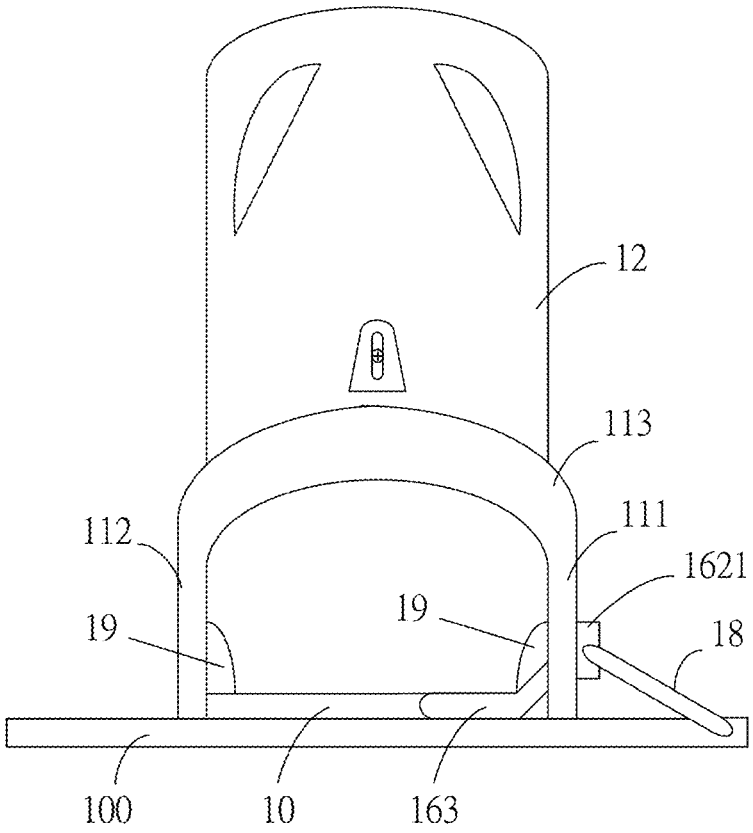
FIG. 5B is a schematic rear view illustrating state that there is a snowboard boot placed in the snowboard binding according to another embodiment of the present invention.

Next, please refer to FIG. 5B illustrating state that there is a snowboard boot placed in the snowboard binding. As shown in FIG. 5B, the linkage 163 is touched when the snowboard boot is stepped, the linkage 163 rotates toward the snowboard 100, and the stopper 18 rotates to parallel the baseplate 10 and results in leaving the snowfield, so that the user can start to slide. At this time, the initial state of the linkage 163 is parallel to the snowfield. After the snowboard boot is lifted away from the linkage 163 and separated from the snowboard binding, the linkage 163 changes its initial state and rotates away from the snowboard 100 by the elastic force of the spring 1621. In the following, the stopper 18 rotates perpendicularly to the baseplate 10 and then insert into the snowfield, therefore the snowboard 100 equipped with the snowboard binding can stop in the snowfield.

While the invention has been described in terms of what is presently considered to be the most practical and preferred embodiments, it is to be understood that the invention needs not be limited to the disclosed embodiments. On the contrary, it is intended to cover various modifications and similar arrangements included within the scope of the appended claims which are to be accorded with the broadest interpretation so as to encompass all such modifications and similar structures.

What is claimed is:

1. A snowboard binding mounted on a snowboard, comprising:

a baseplate;

a boot supporter having a first side, a second side and a heel cup, wherein the boot supporter surrounds the baseplate to form an accommodation boot space for placing a snowboard boot of different sizes;

an interlocking assembly disposed at the first side of the boot supporter, the interlocking assembly comprises a main rod latched to a base, and a linkage set at one end of the main rod which respectively passes through a shaft hole of a first block ring and a second block ring, the linkage, and fixed to the base by sticking a spring to the first block ring near the first block ring, wherein a mutual positional relationship between the interlocking assembly and the snowboard represents an initial state;

an ankle strap extending from the first side to the second side of the boot supporter, respectively connecting to an ankle ladder and a ratchet at two ends, wherein the ankle ladder is disposed at the first side of the boot supporter and kept connected to the ankle strap where a connective rope is set near the ankle ladder to connect to the interlocking assembly, the linkage at the other end connects to the connective rope on the ankle strap, and the ankle strap moves from a locked position to an unlocked position by separating the ankle strap from the ratchet set at the second side of the boot supporter; and a stopper set at the other end of the main rod disposed on the interlocking assembly, the stopper is disposed at the end near the first block ring, and the linkage is disposed at another end opposite to the end where the stopper is disposed, and connects to the connective rope, wherein the length of the stopper is provided for inserting into a snowfield, wherein while the ankle strap moves from the locked position to the unlocked position, the connective rope is driven to move forward to the snowfield, simultaneously the linkage changes the initial state to rotate toward the snowboard, and then triggers the stopper to rotate perpendicular to the baseplate and insert into the snowfield; while the ankle strap moves from the unlocked position to the locked position, the connective rope is driven to leave the snowfield, simultaneously the linkage changes the initial state to rotate away from the snowboard, and then triggers the stopper to rotate parallel to the baseplate and leave the snowfield, so that the stopper leaves or inserts into the snowfield while the snowboard boot is placed in the accommodation boot space and fixed to the snowboard binding.

2. The snowboard binding according to claim 1, further comprising:

a highback attached to the heel cup of the boot supporter for providing aft support to the snowboard boot; and a toe strap disposed on the front part of the snowboard binding opposite to the heel cup of the boot supporter, extending from the first side to the second side of the boot supporter.

3. The snowboard binding according to claim 2, wherein the base has a first screw hole and a second screw hole perforating the base, and wherein the first block ring and the second block ring respectively has the shaft hole set between the first screw hole and the second screw hole on the base.

4. The snowboard binding according to claim 3, wherein an auxiliary is set on the boot supporter below the ankle slider, and a first pivot hole and a second pivot hole are set on the auxiliary respectively corresponding to the first screw hole and the second screw hole on the base of the interlocking assembly.

5. The snowboard binding according to claim 4, wherein the base of the interlocking assembly is affixed on the auxiliary by fastening a first screw on a first pivot hole on the auxiliary through the first screw hole of the base, and fastening a second screw on a second pivot hole on the auxiliary through the second screw hole of the base.

6. The snowboard binding according to claim 2, wherein a push button is set on the ratchet, and the ankle strap is detached from the ratchet by pressing the push button of the ratchet.

7. The snowboard binding according to claim 2, wherein the ankle strap connects to the ratchet when disposed at the locked position, and the ankle strap separates from the ratchet at an angle range from 90° to 180° and facilitates the snowboard boot easily placed into the accommodation boot space when disposed at the unlocked position.

8. A snowboard binding mounted on a snowboard, comprising:

a baseplate;

a boot supporter having a first side, a second side and a heel cup, wherein the boot supporter surrounds the baseplate to form an accommodation boot space for placing a snowboard boot of different sizes; and an interlocking assembly disposed at the first side of the boot supporter, and a stopper disposed on the interlocking assembly, the length of the stopper is provided for inserting into a snowfield, the interlocking assembly comprising:

a base set at the first side on the boot supporter, wherein the first side comprises a hollow part, and a first block ring and a second block ring respectively comprising a shaft hole are set on the base; and a main rod passing through the shaft holes of the first block ring and the second block ring, and fixed to the base by sticking a spring between the first block ring and the second block ring; wherein the main rod has respectively the stopper and a linkage at two ends, the stopper is disposed at the end near the first block ring, the linkage is disposed at another end opposite to the end where the stopper is disposed, and passes through the hollow part of the first side, wherein a mutual positional relationship between the interlocking assembly and the snowboard represents an initial state, and wherein the interlocking assembly is triggered and then changes the initial state, and simultaneously drives the stopper to rotate, so that the stopper leaves or inserts into the snowfield while the snowboard boot is placed in the accommodation boot space and fixed to the snowboard binding.

9. The snowboard binding according to claim 8, wherein while the snowboard boot is put into the snowboard binding, the snowboard boot is stepped and touches the linkage, simultaneously the linkage changes the initial state to rotate toward the snowboard, and then triggers the stopper to rotate parallel to the baseplate and leave the snowfield; while the snowboard boot is raised and leaves the linkage to depart from the snowboard binding, simultaneously the linkage changes the initial state to rotate away from the snowboard, and then triggers the stopper to rotate perpendicular to the baseplate and insert into the snowfield.

* * * * *